US005540470A

United States Patent [19]

Lu

[11] Patent Number: 5,540,470

[45] Date of Patent: Jul. 30, 1996

[54] COLLECTING DEVICE

[75] Inventor: Wen-San Lu, Taipei, Taiwan

[73] Assignee: Tun Yi Electronics Co., Ltd., Taipei, Taiwan

[21] Appl. No.: 523,123

[22] Filed: Sep. 1, 1995

[51] Int. Cl.[6] ..... A01K 29/00; E01H 1/12

[52] U.S. Cl. ..... 294/104; 15/257.6

[58] Field of Search ..... 294/1.3–1.5, 19.1, 294/22, 24, 50.8, 50.9, 55, 104, 115; 15/104.8, 257.1, 257.4, 257.6, 257.7; 119/161, 165

[56] References Cited

U.S. PATENT DOCUMENTS

| | | | |
|---|---|---|---|
| 4,225,174 | 9/1980 | Hennessy et al. | 294/1.4 |
| 4,247,139 | 1/1981 | Grieb . | |
| 4,349,224 | 9/1982 | Shiozaki | 294/1.4 |
| 4,368,907 | 1/1983 | Ross . | |
| 4,383,710 | 5/1983 | Fehr . | |
| 4,398,759 | 8/1983 | Manola . | |
| 4,477,111 | 10/1984 | Crooks . | |
| 4,478,448 | 10/1984 | Albert . | |
| 4,641,873 | 2/1987 | Nurnberger . | |
| 4,741,566 | 5/1988 | Do et al. . | |
| 5,033,781 | 7/1991 | Flood . | |
| 5,056,842 | 10/1991 | Lindenberg et al. . | |
| 5,203,598 | 4/1993 | Lindlbauer . | |
| 5,295,721 | 3/1994 | Wu . | |
| 5,320,393 | 6/1994 | Cortinas . | |
| 5,326,143 | 7/1994 | Babler . | |
| 5,335,952 | 8/1994 | Clapper . | |
| 5,350,208 | 9/1994 | Heinrichson . | |
| 5,380,054 | 1/1995 | Galvis . | |

*Primary Examiner*—Johnny D. Cherry

*Attorney, Agent, or Firm*—Beveridge, DeGrandi, Weilacher & Young, L.L.P.

[57] ABSTRACT

Disclosed is a collecting device used to collect refuse as animal droppings or any matter thrown on the ground in a sanitary and convenient manner that allows the collector to keep hands clean. The collecting device comprises an elongated handle, a paddle mount for mounting a slidable paddle, a featured bag holding mechanism for holding a bag used to contain collected refuse or objects, a paddle controlling mechanism for controlling the paddle to scoop refuse or objects on the ground. The collecting device can be operated effortlessly even by single hand to collect any refuse as animal feces, trash, or any other matter the ground no matter whether the ground is flat or

11 Claims, 4 Drawing Sheets

COLLECTING DEVICE

BACKGROUND OF THE INVENTION

1. Field of the Invention

The present invention relates to collecting devices, and more specifically, to a collecting device used to collect refuse as animal droppings or any matter thrown on the ground in a sanitary and convenient manner that allows the collector to keep hands clean.

2. Description of Prior Art

In many municipalities in the world, there are laws requiring all animal owners to remove the feces left by the animal on public area. To comply with such laws, animal owners who like to carry their pets for a walk at public places are particularly concerned about how they can remove their pets'feces in a sanitary and convenient way.

To do the task in a sanitary and convenient way, a collecting device that is easy to carry and allows the user's hands to be far away from the feces so as to keep the user's hands clean when removing the feces is in demand. To respond to such a demand, there are proposed numerous collecting devices. U.S. Pat. No. 5,320,393 to Cortinas, for instance, discloses a refuse collecting device that is easy to carry and can collect refuse in a sanitary and convenient way. Such collecting device can be used to collect animal feces and place them in a disposable bag. To dispose of the collected feces, the bag can be removed from the collecting device and then thrown away.

There are, however, several drawbacks to the Cortinas' device. First, since the expanding means (30 in the drawing) is always movable along with the slidable tube (26), the expanding means (30) will move upwards concurrently with the slidable tube (26) whenever the user tries to collect another pile of feces, whereby the already collected pile of feces within the bag might be released and then fall off. The bag should therefore be installed first in order to collect another pile of feces. There exists therefore a need for an improved device that can hold the bag immovable all the time so as to allow the refuse collecting device to be capable of collecting refuse repeatedly until the bag is full. Second, the Cortinas' device is useful only when collecting feces on flat ground. On rugged ground, there would be remnants left in a concavity that can not be collected at once into the bag. Third, the Cortinas' device has a grip that is not ergonomically comfortable for the user to hold by hand and awkward to operate.

SUMMARY OF THE INVENTION

It is therefore a primary objective of the present invention to provide an improved collecting device that overcomes the aforementioned drawbacks of the Cortinas' device.

Specifically, it is the first objective of the present invention to provide a collecting device which can be used to collect refuse or any other object on the ground several times until the bag is full.

It is the second objective of the present invention to provide a collecting device which can be used to collect refuse or objects on rugged ground.

It is the third objective of the present invention to provide a collecting device for the user to operate in an ergonomically comfortable manner.

In accordance with the foregoing and other objectives of the present invention, there is provided with an improved collecting device. The collecting device comprises (a) an elongated handle having a top end connected to a grip and a bottom end connected to a base member; (b) a paddle mount connected to the bottom of said elongated handle and having a slot formed thereon; (c) a paddle slidably coupled to said slot on said paddle mount; (d) a bag holding mechanism provided opposite to said paddle mount, including a fixed top holding member, a movable bottom holding member acting in cooperation with said top holding member to hold the bag, a bag releasing member for controlling said bottom holding member, a positioning button for positioning said bag releasing member, a linkage bar connecting said bag releasing member and said bottom holding member, and an elastic member provided between the bottom of said linkage bar and the bottom of said elongated handle; and (e) a paddle controlling mechanism for controlling said paddle to scoop objects on the ground, including an inner tube slidably provided near the top of said elongated handle and having a groove formed thereon, an operating lever enclosing said elongated handle and connected to said inner tube, a positioning pin slidably provided on said groove on said inner tube, a cord connected to said positioning pin and said paddle mount and provided through the inside of said elongated handle, a positioner pivotally coupled to said elongated handle and having a positioning groove formed thereon, an elastic member provided between said paddle mount and said elongated handle for biasing said paddle toward closed position, the other elastic member provided between said positioner and said elongated handle for pushing said positioner away from said elongated handle, and another elastic member provided between said inner tube and said elongated handle for pushing said inner tube downwardly..

BRIEF DESCRIPTION OF DRAWINGS

The present invention can be more fully understood by reading the subsequent detailed description of the preferred embodiments thereof with references made to the accompanying drawings, wherein.

DETAILED DESCRIPTION OF PREFERRED EMBODIMENT

Figure 1:
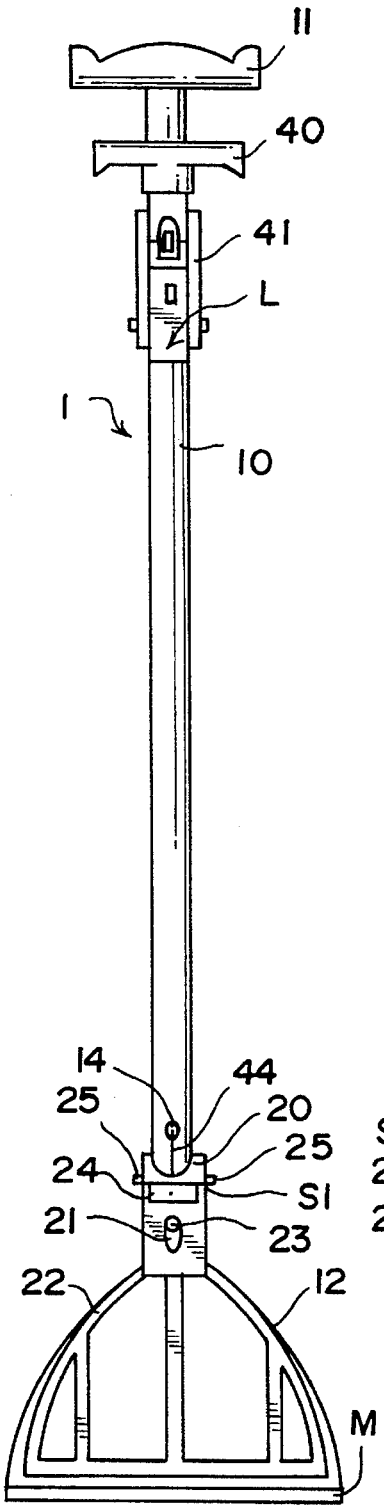
FIG. 1 is a front view of a collecting device according to the first preferred embodiment of the present invention.
Figure 2:
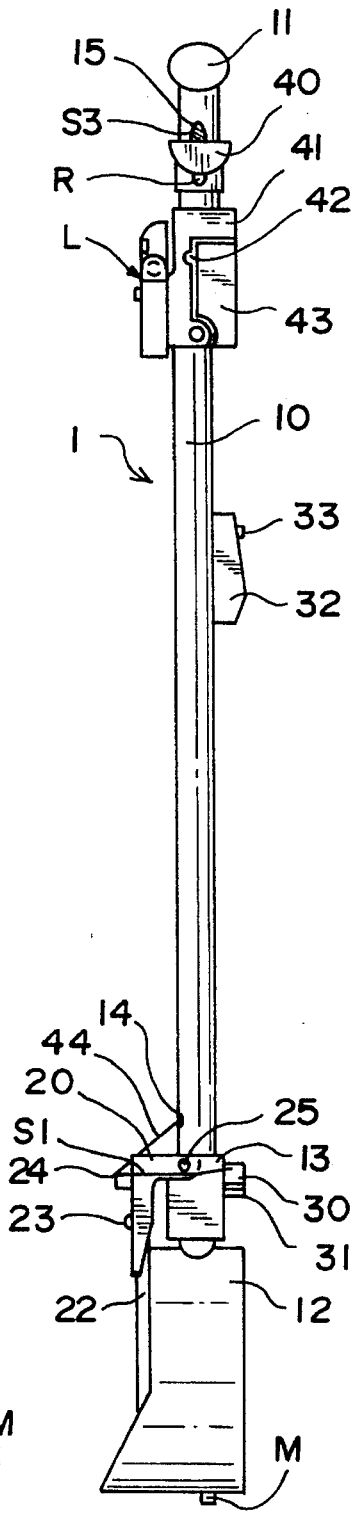
FIG. 2 is a side view of the collecting device of FIG. 1.
Figure 3:
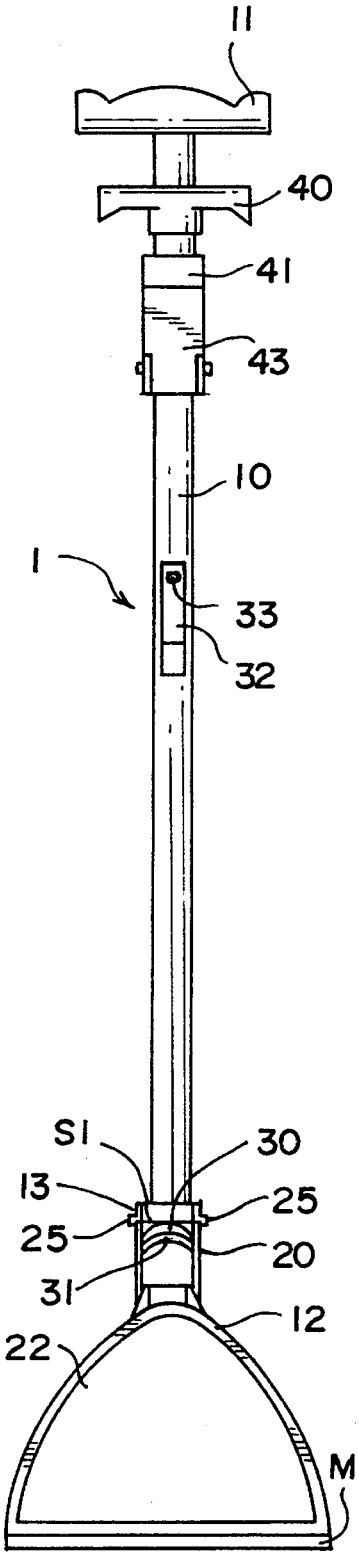
FIG. 3 is a rear view of the collecting device of FIG. 1.

Referring to FIGS. 1–3, there is shown a collecting device 1 according to the first preferred embodiment of the present invention. The collecting device 1 has an elongated handle 10 having a top end connected to a grip 11 and a bottom end connected to a replaceable base member 12. A paddle mount 20 having a slot 21 formed in the middle is provided on a coupler 13 near the bottom end of the elongated handle 10. A paddle 22 is slidably engaged with the paddle mount 20 by means of coupling pin 23 in the slot 21.

A bag holding mechanism is provided on the opposite side of the paddle mount 20, composed of a top curved holding member 30 affixed on the coupler 13 and a movable bottom curved holding member 31 beneath the top curved holding member 30. A releasing device 32 having a positioning button 33 is provided above the middle of the elongated handle 10.

A paddle control mechanism is provided near the grip 11 of the collecting device i for the user to open/close the paddle 22 to collect objects. The paddle control mechanism is composed of an operating lever 40, a positioner 41 formed with a positioning groove 42 and having a cover 43, a steel cord 44 having one end connected through an opening 14 to a securing member 24 on the top of the paddle mount 20, and a first spring $1 coupled to pins 25 on the paddle mount 20 and having two ends affixed to the top of the top curved holding member 30. In other modifications, the steel cord can be replaced by a linkage bar or fiber rope.

An optional, replaceable lighting device L can be mounted on the back of the positioner 41 so that the collecting device i can be used at night or any dark places where visibility is poor. Furthermore, a magnet M can be provided beneath the base member 12, allowing the collecting device to be used to search for iron-made objects, such as needles, on the ground.

Figure 4:
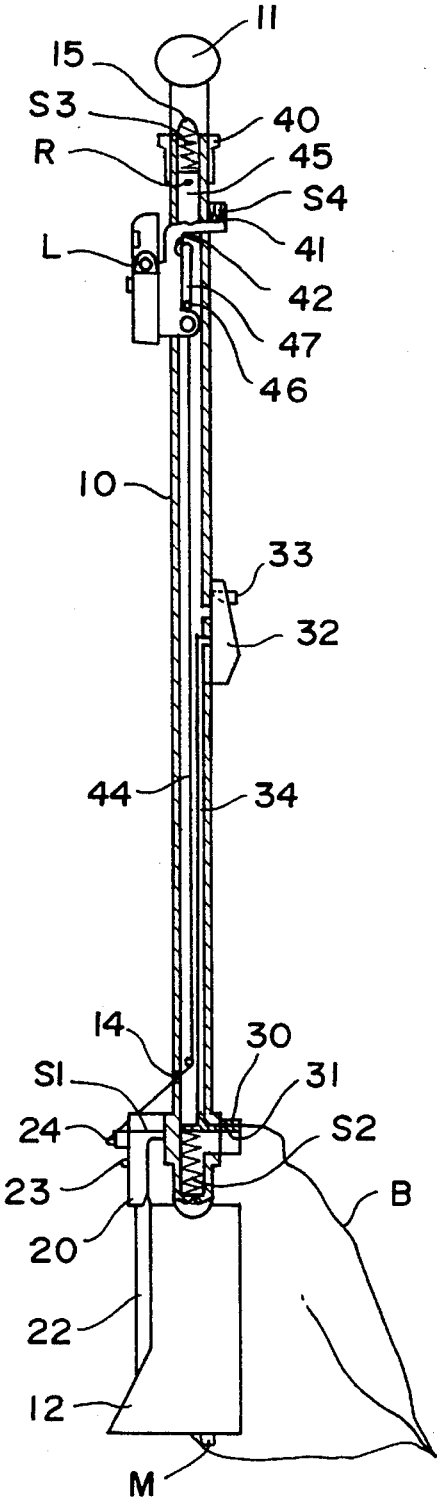
FIG. 4 is a side view of the collecting device of FIG. 1 with parts broken away.

Referring to FIG. 4, the internal structure of the bag holding mechanism and the paddle control mechanism is illustrated in more detail. As shown, inside the elongated handle 10 a linkage bar 34 is provided to connect the releasing device 32 and the bottom curved holding member 31. A second spring S2 is provided between the bottom of the linkage bar 34 and the bottom of the elongated handle 10, allowing the linkage bar 34 and the bottom curved holding member 31 to be pushed downwards when the releasing device 32 is pressed down. Holding the positioning button 33 down allows the bottom curved holding member 31 to be kept in open condition. As shown in FIG. 4, a bag B, which can be made of plastics, paper, or cloth and is used to contain collected objects, is attached to the rim of the base member 12 to firmly secure the bag B, the releasing device 32 is pressed down again to disengage the positioning button 33, thereby allowing the linkage bar 34 along with the bottom curved holding member 31 to be restored to their original positions by means of the elasticity of the spring S2, and thereby firmly clamping the bag B in position, as illustrated in FIG. 4. To detach the bag B, the user can simply press down the releasing device 32 to open the bottom curved holding member 31 and thereby loosen the bag B from its position.

Figure 5:
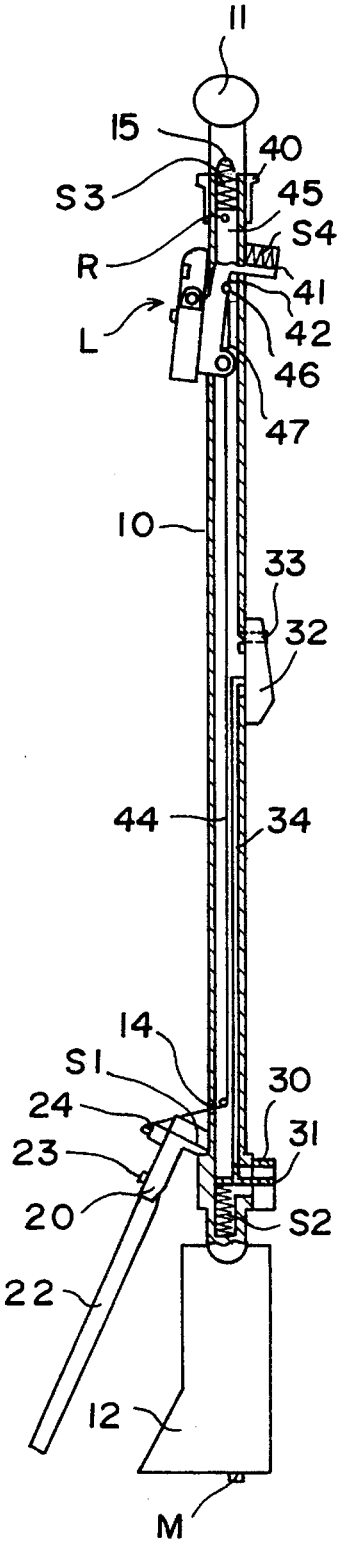
FIG. 5 is a side view of the collecting device of FIG. 1 with parts broken away and showing particularly a paddle being in open condition to scoop refuse into the collecting device.

As shown in FIG. 4, the paddle control mechanism further includes an inner tube 45 inside the elongated handle 10 and near the top. The inner tube 45 is fastened to the operating lever 40 by means of rivet R and movable along groove 15 formed on the top of the elongated handle 10. A positioning pin 46, which is connected to the top end of the steel cord 44, is movable abutting the rim of the positioner 41 along the positioning groove 47 formed on the bottom side of the inner tube 45. Further, a third spring S3 is provided between the top of the inner tube 45 and the top end of the elongated handle 10, and a fourth spring S4 is provided between the top of the positioner 41 and the elongated handle 10. In operation of collecting a mass of refuse or any other object on the ground, the user needs to pull the operating lever 40 upwards with his or her hand on the grip 11. This movement brings the inner tube 45, positioning pin 46, and the steel cord 44 to rise from the positions illustrated in FIG. 4, thereby forcing the paddle mount 20, which is connected to the steel cord 44, to rise and thus open the paddle 22. The movement is stopped when the positioning pin 46 reaches the positioning groove 42 one the positioner 41 which is then pivoted outwards by means of the spring S4 to engage the positioning pin 46 on the positioning groove 42. At this time the user needs to release the operating lever 40. As then shown in FIG. 5, the paddle 22 falls due to gravity from the initial position on the slot 21 to the bottom,most position. At the same time, the operating lever 40 along with the inner tube 45 return to the initial position due to the elastic restoration of the spring S3.

With the paddle 22 being open, the user needs then to press down the positioner 41 so as to disengage the positioning pin 46 from the positioning groove 47, which then causes the paddle mount 20 along with the paddle 22 to be switched back to the original position, thereby scooping anything in front of the opening of the base member 12 into the bag B. Since the paddle 22 is movable along the slot 21 on the paddle mount 20, it can be adjusted automatically in position so as to come in touch with the level of any rugged ground to collect refuse or objects thereon. Also, the steel cord 44 within the inside of the elongated handle 10 is pulled downwards due to the action, such that the positioning pin 46 connected to the steel cord 44 is pulled along the positioning groove 47 on the inner tube 45 back to the initial position as shown in FIG. 4. The operation of collecting is thus completed.

Figure 6:
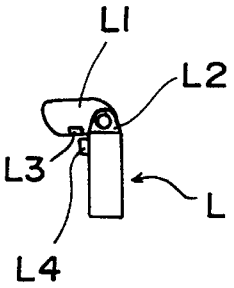
FIG. 6 shows a side view of a lamp employed in the collecting device of FIG. 1, showing particularly that the lamp head is turned toward the bottom.
Figure 7:
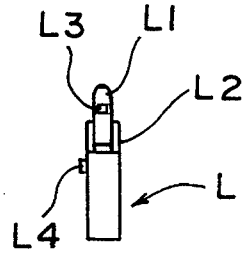
FIG. 7 shows a side view of the lamp of FIG, 6 except that here the lamp head is turned toward the left.
Figure 8:
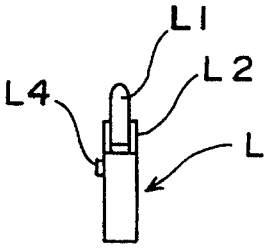
FIG. 8 shows a side view of the lamp of FIG. 6 except that here the lamp head is turned toward the right.

Referring to FIG. 6, the lighting device L provided on the back of the positioner 41 includes a head L1, a mount L2, a light source L3, and a switch L4. The head L1 can be turned downwardly by 90° in angle. Further, the mount L2 can be turned azimuthally by 180° as illustrated in FIGS. 7 and 8 so as to provide all-direction illumination to the ground when the collecting device is used at night or any place where ambient light is dim.

Figure 9:
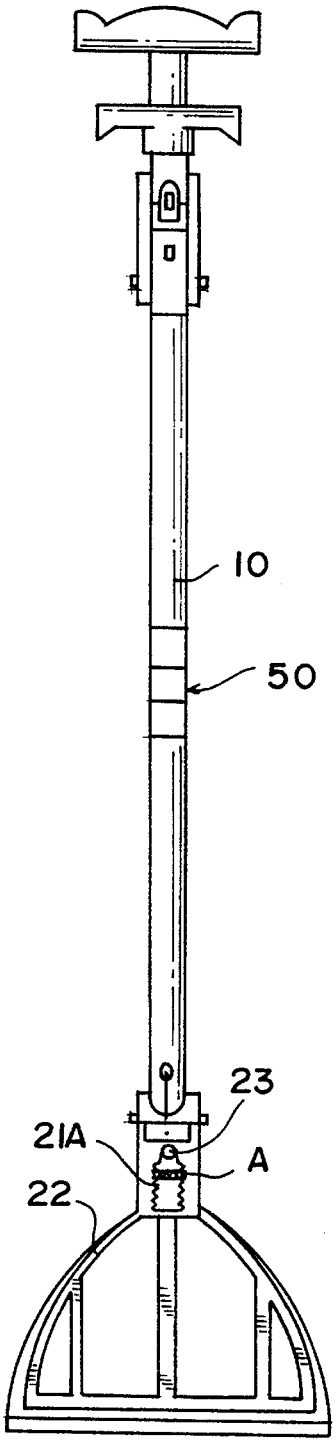
FIG. 9 shows a front view of another preferred embodiment of the collecting device according to the present invention.
Figure 10:
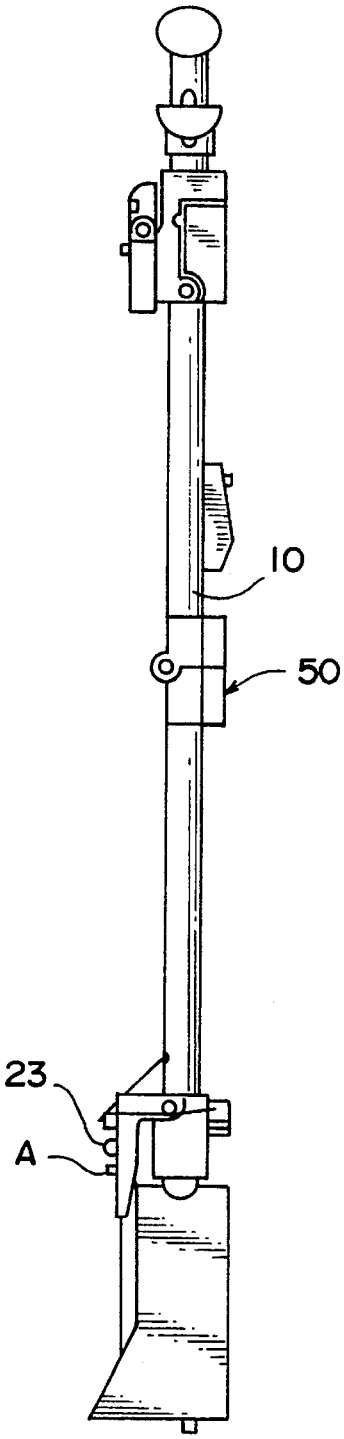
FIG. 10 shows a side view of the collecting device of FIG. 9.
Figure 11:
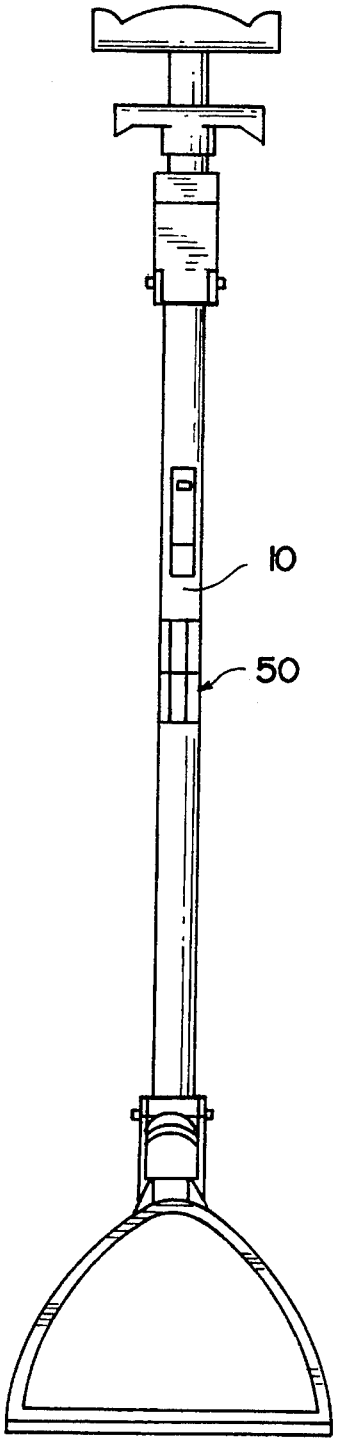
FIG. 11 shows a rear view of the collecting device of FIG. 9.
Figure 12:
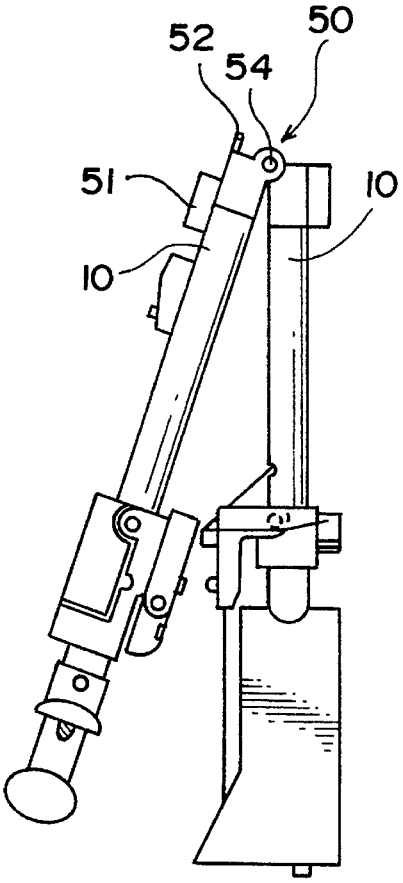
FIG. 12 shows a side view of the collecting device of FIG. 9 when it is not in use and folded for storage.

FIGS. 9–11 show another preferred embodiment of the collecting device according to the present invention. This embodiment is different from the previous one only in that a hinge member 50 is provided in the middle of the elongated handle 10, allowing the collecting device to be collapsible as shown in FIG. 12 for convenient storage or portability when not in use.

Figure 13:
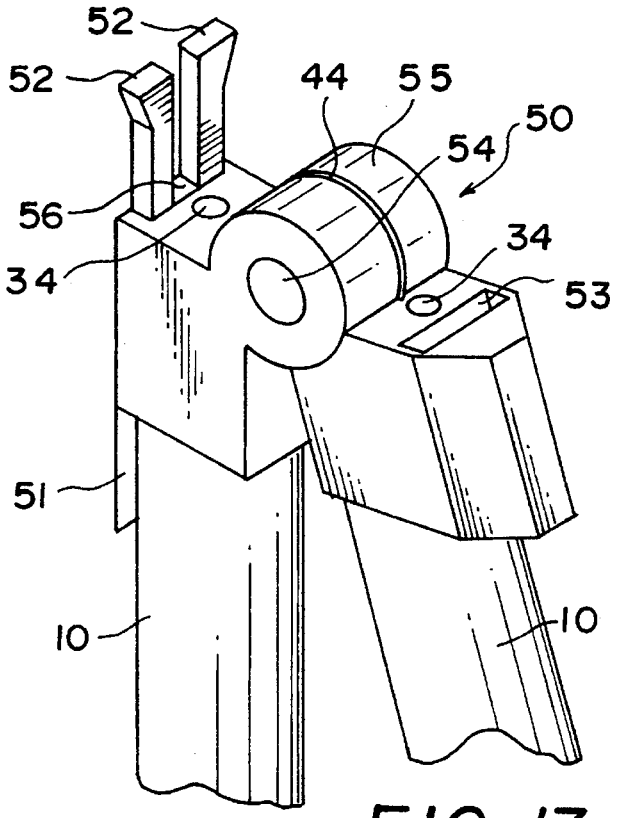
FIG. 13 shows a perspective view of a hinge that allows the collecting device of FIG. 9 to be foldable for storage.
Figure 14:
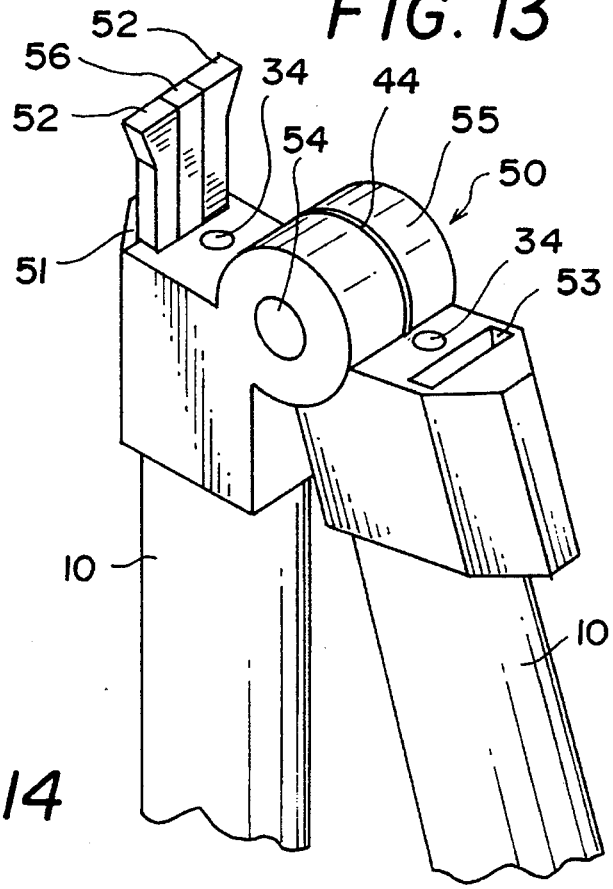
FIG. 14 shows a perspective view of the hinge of FIG. 13, showing particularly that a hinge button is pushed back to its original position.

To collapse the collecting device, the user needs to push a hinge button 51 on the hinge member 50 so as to urge two engaging members 52 to bend inwards to be disengaged from recess 53 and then rotate the upper section about the axis 54, as illustrated in FIG. 13. In order to allow the collapsible function of the collecting device, the steel cord 44, which is connected between the positioning pin 46 and the paddle mount 20, is wound around the hinge joint 55 and the linkage bar 34 in the bag holding mechanism is formed with two sections. Further as shown in FIG. 14, when the hinge button 51 is pushed back to original position, a securing member 56 affixed on the hinge button 51 rises between the two engaging members 52, thereby preventing the two engaging members 52 from bending inwards. Therefore, when the user wishes to extend the collecting device from collapsed condition so as to use it, the hinge button 51 should be held open so as to let the securing member 56 to withdraw to a position as illustrated in FIG. 13; then the hinge member 50 is turned so as to let the engaging members 52 be inserted back to the recess 53; and finally the hinge button 51 is pushed back to original position to let the securing member rise between the two engaging members 52 and let the engaging members 52 be securely engaged with the recess 53. In various modifications, the elongated handle 10 can be made with two or three telescopic sections so that its overall length can be shortened for easy portability or storage when not in use.

Referring back to FIG. 9, the collecting device can further includes a toothed slot 21A provided on the paddle mount 20 and a vertically movable stopper A formed with teeth meshing to the toothed slot 21A. To collect refuse or objects on rugged ground, the user can manually move the stopper A to adjust its position so as to decide the distance the paddle 22 travels within. For example, when collecting refuse or objects on flat ground, the stopper A can be adjusted to be positioned near the top so as to shorten the travelling distance of the paddle 22; and whereas when collecting refuse or objects on rugged ground, the stopper A can be adjusted to be positioned near the bottom so as to lengthen the travelling distance of the paddle 22.

In conclusion, the collecting device according to the present invention has several advantages over the prior art. First, the collecting device according to the present invention is capable of collecting repeatedly a series of masses of refuse or lots of objects on the ground until the bag is full. Second, with the grip and the operating lever of the collecting device according to the present invention, the user can hold and operate the collecting device in an ergonomically comfortable manner. Third, the collecting device is capable of collecting refuse or objects on rugged ground, which is a benefit the prior art lacks. Fourth, the collecting device according to the present invention is provided with a featured bag holding mechanism that allows the user to dispose of the bag by simply pressing down a button to release the bag to a garbage can, for example. The disposal thus can be carried out all in a sanitary manner. Fifth, the collecting device according to the present invention can be made mostly with plastics so that it is light-weighted for better portability and low in material and manufacture costs. It can be also collapsible or retractable for convenient portability and storage. Sixth, the collecting device according to the present invention, in addition to being used to collect animal feces, can be used in substitute for brooms to collect any garbage or things like broken glass or vase that is dangerous to be collected by bare hand It also allows the user who has a back problem to collect any matter on the ground without having to bend his or her back. Seventh, the collecting device according to the present invention is provided with a lighting device that provides illumination to the ground when used at night and the wide-angle head of the lighting device allows wide area of illumination that allows the user to clearly see the object to be collected. Eighth, with the provision of a magnet, the collecting device according to the present invention can be additionally used to collect iron-made objects such as needles or pins on the ground. Ninth, the base member and the paddle are all replaceable so that when they are damaged, replacement of a new one can be cost-effectively made.

The present invention has been described hitherto with exemplary preferred embodiments. However, it is to be understood that the scope of the present invention need not be limited to the disclosed preferred embodiments. On the contrary, it is intended to cover various modifications and similar arrangements within the scope defined in the following appended claims. The scope of the claims should be accorded the broadest interpretation so as to encompass all such modifications and similar arrangements.

What is claimed is:

1. A collecting device for collecting objects into a bag, comprising:

(a) an elongated handle having a top end connected to a grip and a bottom end connected to a base member;

(b) a paddle mount connected to the bottom of said elongated handle and having a slot formed thereon;

(c) a paddle slidably coupled to said slot on said paddle mount;

(d) a bag holding mechanism provided opposite to said paddle mount, including a fixed top holding member, a movable bottom holding member acting in cooperation with said top holding member to hold the bag, a bag releasing member for controlling said bottom holding member, a positioning button for positioning said bag releasing member, a linkage bar connecting said bag releasing member and said bottom holding member, and an elastic member provided at the bottom of said linkage bar and the bottom of said elongated handle; and (e) a paddle controlling mechanism for controlling said paddle to scoop objects on the ground, including an inner tube slidably provided near the top of said elongated handle and having a groove formed thereon, an operating lever enclosing said elongated handle and connected to said inner tube, a positioning pin slidably provided within said groove on said inner tube, a steel cord connected to said positioning pin and said paddle mount and provided through the inside of said elongated handle, a positioner pivotally coupled to said elongated handle and having a positioning groove formed thereon, and an elastic member provided between said paddle mount and said elongated handle for biasing said paddle toward closed position.

2. A collecting device as claimed in claim 1, further comprising an elastic member provided between the top of said positioner and said elongated handle so as to allow said positioner to be pivoted outwards by means of the elasticity of said elastic member.

3. A collecting device as claimed in claim 1, further comprising an elastic member provided between the top of said elongated handle and the top of said inner tube for pushing said inner tube downwardly.

4. A collecting device as claimed in claim 1, wherein said cord is a linkage bar.

5. A collecting device as claimed in claim 1, wherein said cord is a fiber rope.

6. A collecting device as claimed in claim 1, further comprising a hinge member provided on the elongated handle so as to allow said collecting device to be collapsible.

7. A collecting device as claimed in claim 6, wherein said hinge member comprises a movable hinge button, pair of engaging members, and a recess for engaging said engaging members therein, and a securing member affixed to said hinge button for controlling the engagement and disengagement between said engaging members and said recess.

8. A collecting device as claimed in claim 1, wherein said elongated handle is composed of a plurality of telescopic sections.

9. A collecting device as claimed in claim 1, further comprising a replaceable lighting device with tilting head and rotational mount.

10. A collecting device as claimed in claim 1, further comprising a magnet on the bottom.

11. A collecting device as claimed in claim 1, wherein said groove formed on said paddle mount is toothed and meshed with a toothed stopper which is movable along said toothed groove.

* * * * *